US008581797B2

(12) United States Patent
Lill et al.

(10) Patent No.: US 8,581,797 B2
(45) Date of Patent: Nov. 12, 2013

(54) COMPACT DIPOLE ADAPTER FOR WHIP ANTENNA

(75) Inventors: James P. Lill, Rochester, NY (US); Stephan E. Sykes, Victor, NY (US)

(73) Assignee: Harris Corporation, Melbourne, FL (US)

( * ) Notice: Subject to any disclaimer, the term of this patent is extended or adjusted under 35 U.S.C. 154(b) by 429 days.

(21) Appl. No.: 13/075,512

(22) Filed: Mar. 30, 2011

(65) Prior Publication Data

US 2012/0249391 A1 Oct. 4, 2012

(51) Int. Cl.
*H01Q 9/16* (2006.01)

(52) U.S. Cl.
USPC ..... 343/793; 343/860; 343/895

(58) Field of Classification Search
USPC ..... 343/793, 860, 895
See application file for complete search history.

(56) References Cited

U.S. PATENT DOCUMENTS

| | | | | |
|---|---|---|---|---|
| 4,125,840 | A | 11/1978 | Cassel | |
| 5,289,198 | A | 2/1994 | Altshuler | |
| 2005/0090300 | A1* | 4/2005 | Zhang et al. | 455/575.7 |
| 2005/0285798 | A1* | 12/2005 | van Wonterghem et al. | 343/702 |
| 2008/0252535 | A1 | 10/2008 | Parsche | |
| 2011/0273354 | A1* | 11/2011 | Davidson | 343/852 |

OTHER PUBLICATIONS

Operation Manual, "RF-1942-AT001 HF Vehicular Antenna Kit" Harris Corporation; Publication No. 10515-0190-4200, Oct. 2001.
European Search Report mailed Jun. 28, 2012; European Application No. 12000986.5-2220 in the name of Harris Corporation.

* cited by examiner

*Primary Examiner* — Allyson Trail
(74) *Attorney, Agent, or Firm* — Fox Rothschild, LLP; Robert J. Sacco

(57) ABSTRACT

A portable whip antenna (100) is used to form a parallel wire transmission line (304) and support for a dipole antenna system (900). The portable whip antenna is formed of an elongated monopole radiating element (306) extending from a feed point (114, 202) comprising an RF connector, which can be connected directly to a portable radio transceiver (200). A first flexible conductor extends parallel to and spaced apart from the elongated monopole radiating element of the whip antenna to form the parallel wire transmission line. A first dipole element (512) is formed from a portion of the first flexible conductor extending from a link member in a first direction transverse to a length of the elongated monopole radiating element. A second dipole radiating element (516) is formed of an elongated length of a second flexible conductor (522) extending in a second direction transverse to the elongated monopole radiating element.

25 Claims, 8 Drawing Sheets

COMPACT DIPOLE ADAPTER FOR WHIP ANTENNA

BACKGROUND OF THE INVENTION

1. Statement of the Technical Field

The inventive arrangements relate to methods and systems for adapting antennas for various operating conditions, and more particularly for adapting a whip type antenna to a dipole antenna having either a flat-top, inverted-L or inverted-V configuration.

2. Description of the Related Art

A whip antenna generally consists of a single driven linear element, which may be formed of a flexible rod member. The rod member is sometimes mounted above a ground plane for improved performance. A whip or monopole antenna has an omni-directional radiation pattern, meaning that the radiation gain is the same in all azimuth directions. The gain tends to diminish with increasing elevation angle, such that antenna gain is practically zero in a direction aligned with the axis of the antenna. While this arrangement works well for many applications, it is not well suited for Near Vertical Incidence Skywave or NVIS communications.

A portable vertical whip or monopole antenna is frequently used with various portable manpack transceivers. One such portable vertical whip antenna is an AT-271 antenna (also known as AS-271/PRC; National Stock Number NSN 5820-00-242-4967). Maximum range of ground-wave communications with a portable whip antenna such as the AT-271 is typically about 15 miles on the battlefield. However, modern battlefield doctrine also uses HF manpack transceivers for communications in the range of 25-200+ miles. Such distances require an antenna capable of NVIS (overhead pattern) performance.

For reasons explained above, vertical monopole antennas like the AT-271 are not generally suited for NVIS communications. Other antennas, such as the AS-2259 antenna system (also known as the AS-2259/GR; NSN 5980-00-106-6130) are well suited for NVIS; however, the AS-2259 is generally shunned due to its weight and bulk. Manpack HF transceivers are designed for users who operate in what the military refers to as "dismounted" configuration, i.e. a soldier with a radio on his back. Most HF dismount use has an element of covert or inserted operation. As such, these operations require small/light and quick to deploy antennas for which the AS-2259 is not well suited. Both the AT-271 and AS-2259 are produced many manufacturers but their design is dictated by military specifications.

A simple wire dipole type antenna can work well for NVIS communications. However, wire antennas of this kind have limited performance if they are too close to the ground. In many tactical environments, the absence of suitable support structures means that a wire dipole antenna will either be placed directly on or just a few inches above the ground. The result is relatively poor antenna performance. Wire antennas can be raised up above the ground if support structures are present. However, such support structures are often heavy and bulky, making them impractical to carry.

The RF-1942 (RF-1942-AT001) is a military HF vehicular antenna kit which can be configured in several different ways for different operational scenarios. The antenna includes a plurality of composite tubular sections that can be threaded together to form a whip antenna. The antenna kit also includes an inverted "V" component which is used to convert the whip antenna to an inverted "V" configuration. The inverted "V" component consists of a insulated winder structure onto which two wire antenna elements can be wound when stored.

The winder structure is essentially a solid block of insulating material which is fixed to a female threaded element. The female threaded element can be screwed onto a male threaded element at the top end of the whip antenna.

One problem with the RF-1942 concerns deployment of the wire elements used to form an inverted "V" antenna. The wire elements which form the inverted "V" inevitably become twisted when unwrapped from the winder structure. The twisted wires are difficult to deploy and have a tendency to become tangled. This problem is compounded when the winder element is threaded onto the top end of the whip antenna. The problem is also compounded due to a downlead portion of one of the wire elements which extends adjacent to a length of the whip antenna to an antenna feed point. Once the winder is tightly threaded onto the top of the whip antenna, it is substantially fixed in position relative to the whip. In other words, the winder is not generally free to rotate around the whip. Consequently, when wire dipole antenna elements are deployed from the rigid and fixed structure of the winder, the wire elements forming the dipole antenna cannot be freely rotated around the axis of the whip antenna for purposes of facilitating deployment. This can be nuisance when trees or other obstacles interfere with deployment of the wire elements. Moreover, the down-lead element of the RF-1942 which extends along the length of the whip is formed as one continuous element with one of the dipole elements. This continuous element is threaded through the winder. Consequently, any rotation of the winder structure that does happen to occur will result in the down-lead component becoming wrapped or twisted around the whip antenna. As a practical matter, this arrangement tends to be inconvenient to deploy in the field.

SUMMARY OF THE INVENTION

Embodiments of the invention concern a method for adapting a portable whip antenna for use in a dipole antenna system. The method involves forming a parallel wire transmission line using the portable whip antenna and an elongated length of a first flexible conductor. The parallel wire transmission line is formed by extending the first flexible conductor parallel to and spaced apart from a length of an elongated monopole radiating element comprising the whip antenna. The first flexible conductor is physically secured at one end to a ground post (for example a ground post of a portable radio transceiver). The ground post can be situated adjacent to an RF connector at a feed point of the whip antenna. The first flexible conductor is also secured at a location adjacent to an end portion of the portable whip antenna distal from the feed point. The first flexible conductor is further extended from the location in a first direction transverse to the length of the elongated monopole radiating element to form a first dipole element.

A second dipole radiating element is formed by electrically connecting an elongated length of a second flexible conductor to the end portion of the whip antenna and extending the second flexible conductor in a second direction transverse to the length of the elongated monopole radiating element. The RF connector at the feed point of the whip antenna can be supported by an RF port of a portable radio transceiver such that the whip antenna has a generally vertical orientation. With the whip antenna vertically supported in this way, the whip antenna can serve as a support for positioning the dipole elements off the surface of the ground while also serving as one element of a parallel wire transmission line.

The invention also concerns a system in which a portable whip antenna is used to form a transmission line and support for a dipole antenna. The system includes a portable whip antenna formed of an elongated monopole radiating element extending from a feed point comprising an RF connector. According to one aspect of the invention, the RF connector can be connected directly to a portable radio transceiver. An elongated length of a first flexible conductor is connected at one end to a ground post which can be adjacent to the feed point. The first flexible conductor extends parallel to and spaced apart from the elongated monopole radiating element of the whip antenna to form in combination a parallel wire transmission line.

A link member physically secures the flexible conductor at a location adjacent to an end portion of the portable whip antenna, distal from the feed point. A first dipole element is formed from a portion of the first flexible conductor extending from the link member in a first direction transverse to a length of the elongated monopole radiating element. A second dipole radiating element is formed of an elongated length of a second flexible conductor. The second flexible conductor is electrically connected to the end portion and extends in a second direction transverse to the elongated monopole radiating element. The whip antenna is supported at the RF connector in a generally vertical orientation. For example, a portable radio transceiver to which the RF connector is secured can be used to support the whip antenna. In this way, the whip antenna can support the first and second dipole elements a distance off a surface of the ground.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
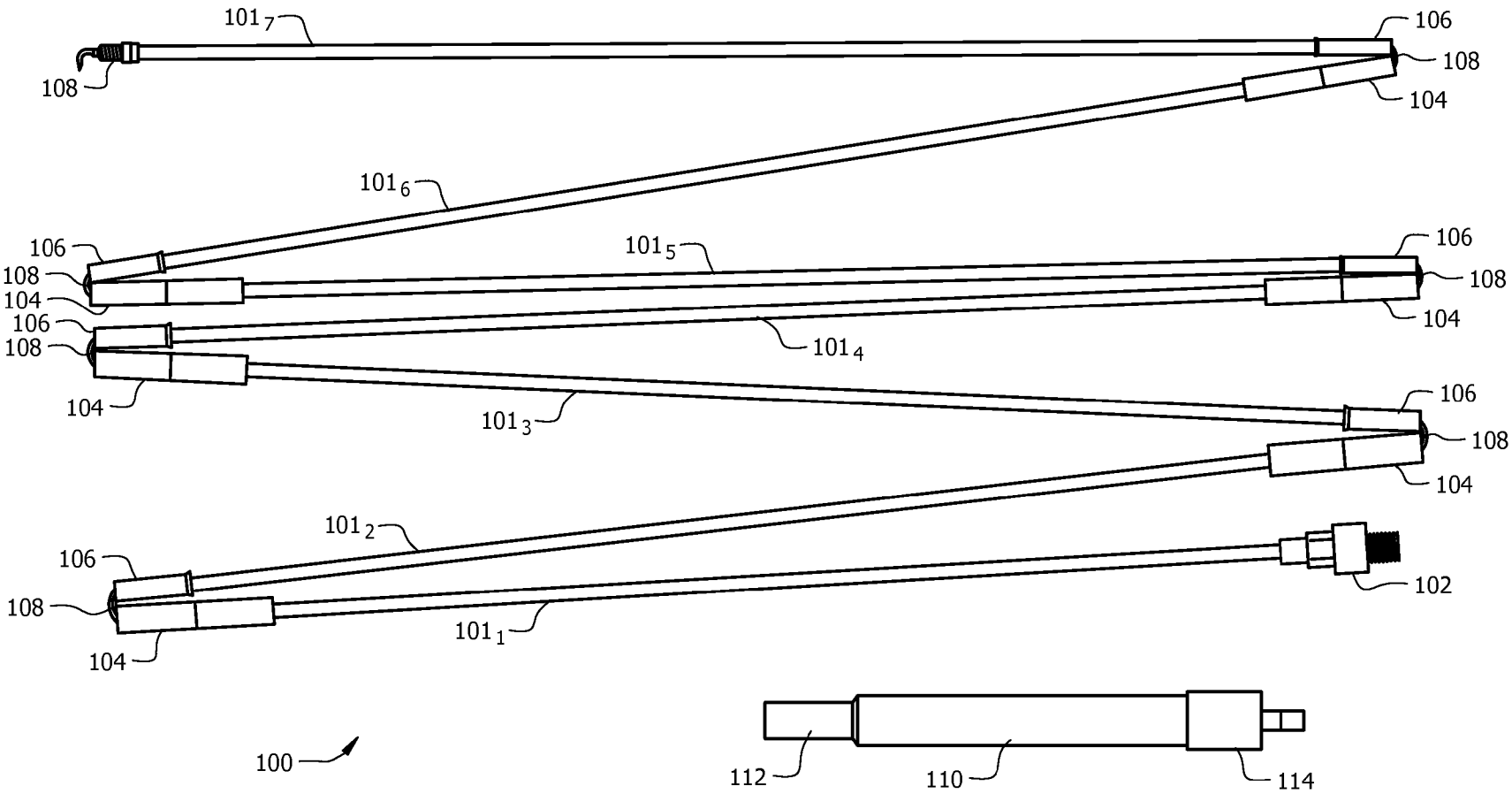
FIG. 1 (Prior Art)
FIG. 1 a drawing that is useful for understanding a portable whip antenna design of the prior art.

Referring now to FIG. 1, a method for adapting a portable whip antenna for use in a dipole antenna system will now be described in further detail. As shown in FIG. 1, the construction of a portable whip antenna 100 typically includes a monopole radiator formed from a set of hollow tubular conductive sections $\mathbf{101}_1$-$\mathbf{101}_7$. In some embodiments, the tubular conductive sections can be formed entirely of metal, but other arrangements are also possible provided that each section provides excellent conduction along its length. Also, while seven hollow tubular conductive sections are shown in FIG. 1, it should be understood that portable whip antennas as referred to herein can have any number of tubular conductive sections.

Each tubular conductive section $\mathbf{101}_1$-$\mathbf{101}_7$ has a conductive plug 106 on one end and a conductive socket 104 on an opposing end. When the antenna is assembled, the plug 106 from each hollow tubular conductive section fits into a corresponding socket 104 of an adjacent section to form the 10 foot long monopole radiator. The exception would be the tubular conductive section $\mathbf{101}_1$ which has an RF connector 102 provided at one end for connecting the antenna to a base 110. The base 110 has a socket 112 for receiving the RF connector 102, and has a second RF connector 114 at an opposing feed point end for connecting the portable whip antenna 100 to a portable transceiver. A cord 108 is threaded through a bore formed in each of the hollow metal sections to keep the elements in proper order when they are disconnected from one another. The overall length of a portable whip antenna will vary depending on the application. For example in the case of the AT-271, the overall length of the assembled antenna, including an 8" long tubular base 110, is 121.5 inches (3.09 meters). Still, the invention is not limited in this regard and any length portable whip antenna can be used for the invention described herein.

Figure 2:
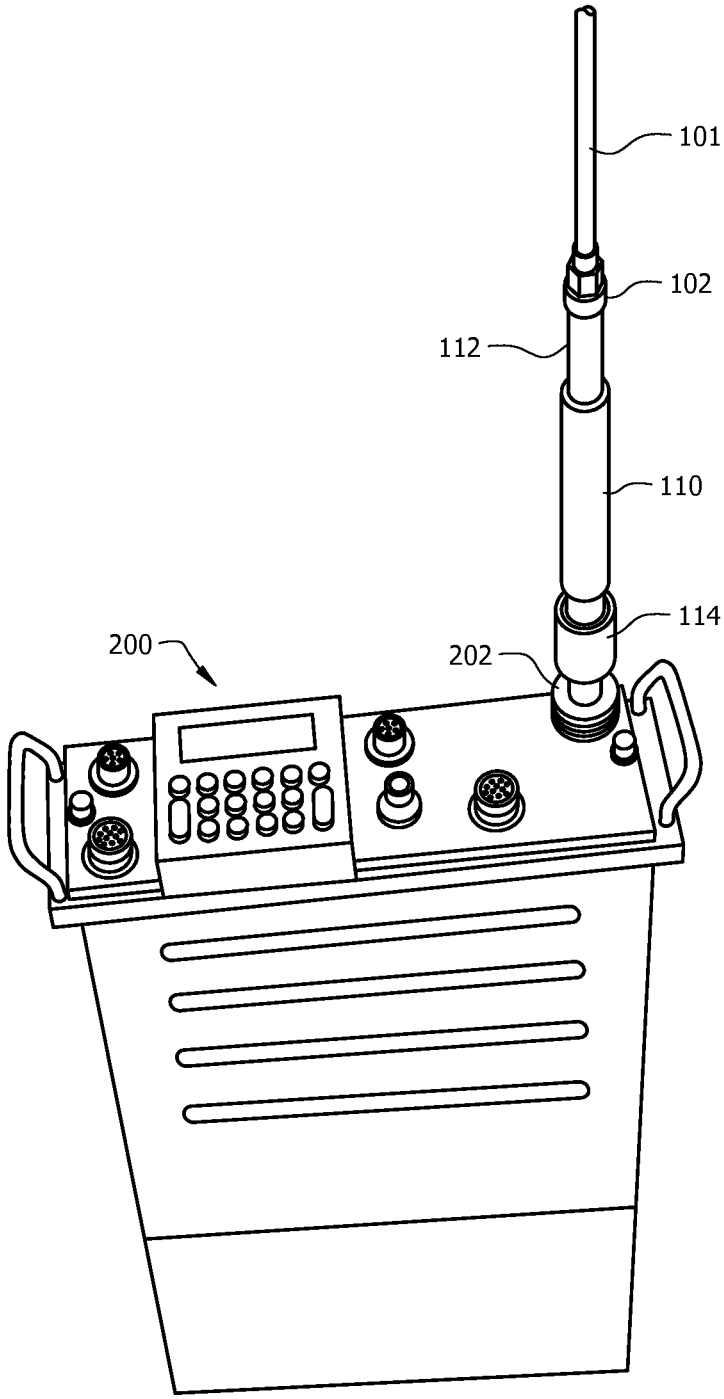
FIG. 2 (Prior Art)
FIG. 2 is a drawing that is useful for understanding a prior art operating configuration for a portable transceiver and a portable whip antenna as shown in FIG. 1.

Referring now to FIG. 2, the portable whip antenna 100 from FIG. 1 is shown connected to an RF connector 202 at an antenna port of a portable radio transceiver 200. As can be observed in FIG. 2 the RF connector 202 on the portable radio transceiver supports the monopole radiator element 100 in a generally vertical orientation relative to the ground. The present method is particularly well suited for whip antenna arrangements similar to those described with respect to FIGS. 1 and 2. However, it should be understood that the invention is not limited to portable whip antennas having seven tubular conductive sections $\mathbf{101}_1$-$\mathbf{101}_7$ as shown in FIG. 1. Instead, the invention can be used with portable whip antennas having any number of sections $\mathbf{101}_1$-$\mathbf{101}_n$. Also, the invention is not limited to an arrangement in which the portable whip antenna is directly connected to the portable radio transceiver 200. Instead, the portable whip antenna could be mounted in a generally vertical orientation by attaching the antenna to a small tripod or support member (not shown). In such an arrangement, RF signals can be communicated between the portable transceiver and the feed point of the portable whip antenna by means of a short length of RF transmission line. For example, a short length of coaxial cable could be used for this purpose. Still, it is preferable to connect the portable whip antenna directly to the portable radio transceiver for improved operating efficiency and reduced loss.

Figure 3:
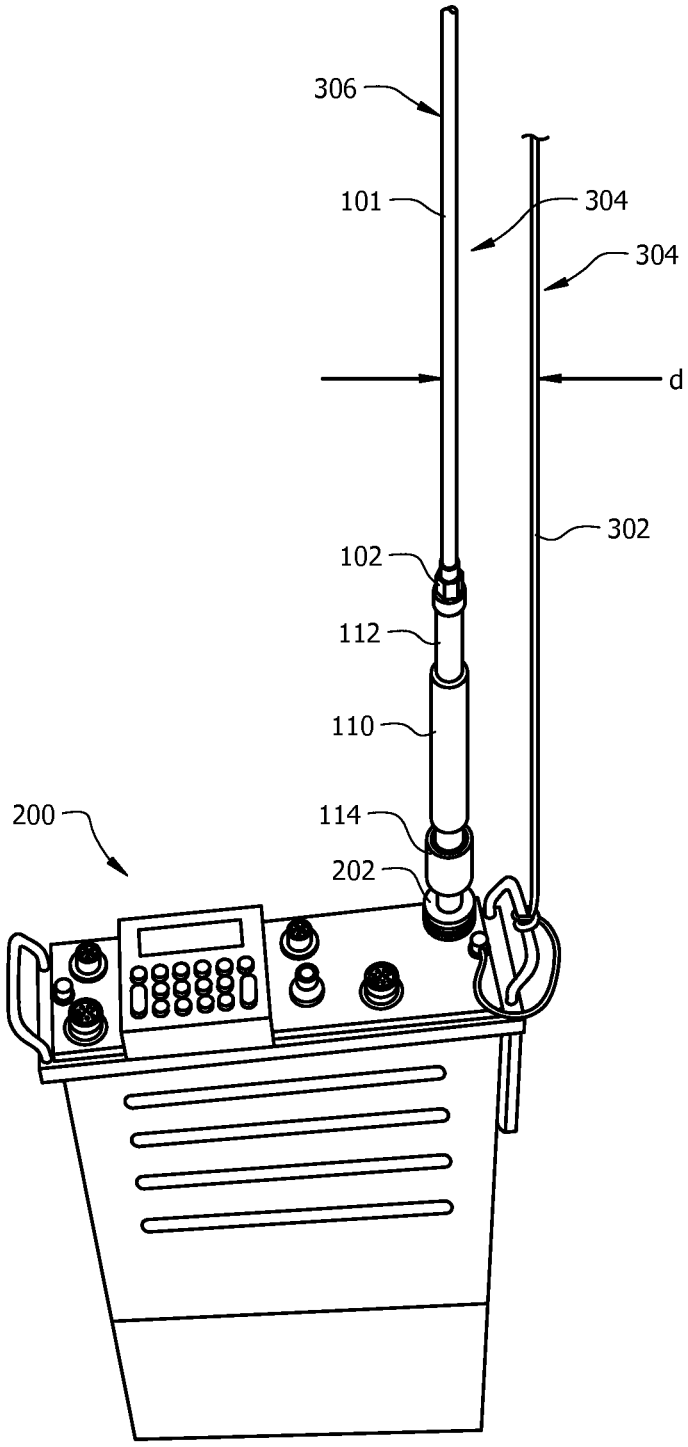
FIG. 3 is a drawing that is useful for understanding an arrangement for using the portable whip antenna of FIG. 1 to provide a support and a feed line for a dipole antenna system.

The method can begin with a portable whip antenna 100 already at least partially assembled and mounted on a portable radio transceiver 200 as shown in FIG. 2. Methods for assembling such portable antennas are well known in the art and therefore will not be described here in detail. However, a suitable standard RF connector is generally provided for connecting the antenna to the portable radio transceiver 200. Referring now to FIG. 3, the method can continue by forming a parallel wire transmission line 304 using the portable whip antenna 100 and an elongated length of a first flexible conductor 302. The parallel wire transmission line 304 is formed by extending the first flexible conductor 302 parallel to and spaced apart from a length of the elongated monopole radiating element 306 comprising the portable whip antenna 100. Any suitable flexible conductor can be used for this purpose provided that it has sufficient length and excellent conductivity. For example, the flexible conductor used herein can be a conventional copper wire. Although not necessary for purposes of the invention, it can be advantageous to use an insulated flexible conductor to reduce the potential for damage to the radio transceiver in the event that the flexible conductor inadvertently comes in contact with the monopole radiating element 306. Still, the invention is not limited in this regard.

The characteristic impedance of the parallel wire transmission line 304 will vary as a function of the distance d between the first flexible conductor 302 and the elongated monopole radiating element 306. In some embodiments, the insulating stand-offs or spacers (not shown) can be provided periodically along the length of the radiating element 306 and the first flexible conductor 302 to control this distance. However, those skilled in the art will appreciate that many portable radio transceivers currently include wide range automatic antenna tuners and in such case the exact impedance of the parallel wire transmission line 304 is not critical. The distance d between the monopole radiating element 306 and the first flexible conductor 302 is preferably maintained at a reasonable distance that is much less than the wavelength of the signals which are being communicated. For example, in the case where the portable transceiver is operating in the high frequency (HF) range, the distance is advantageously maintained between about 0.5 inches and six inches. Still, the invention is not limited in this regard.

Figure 4:
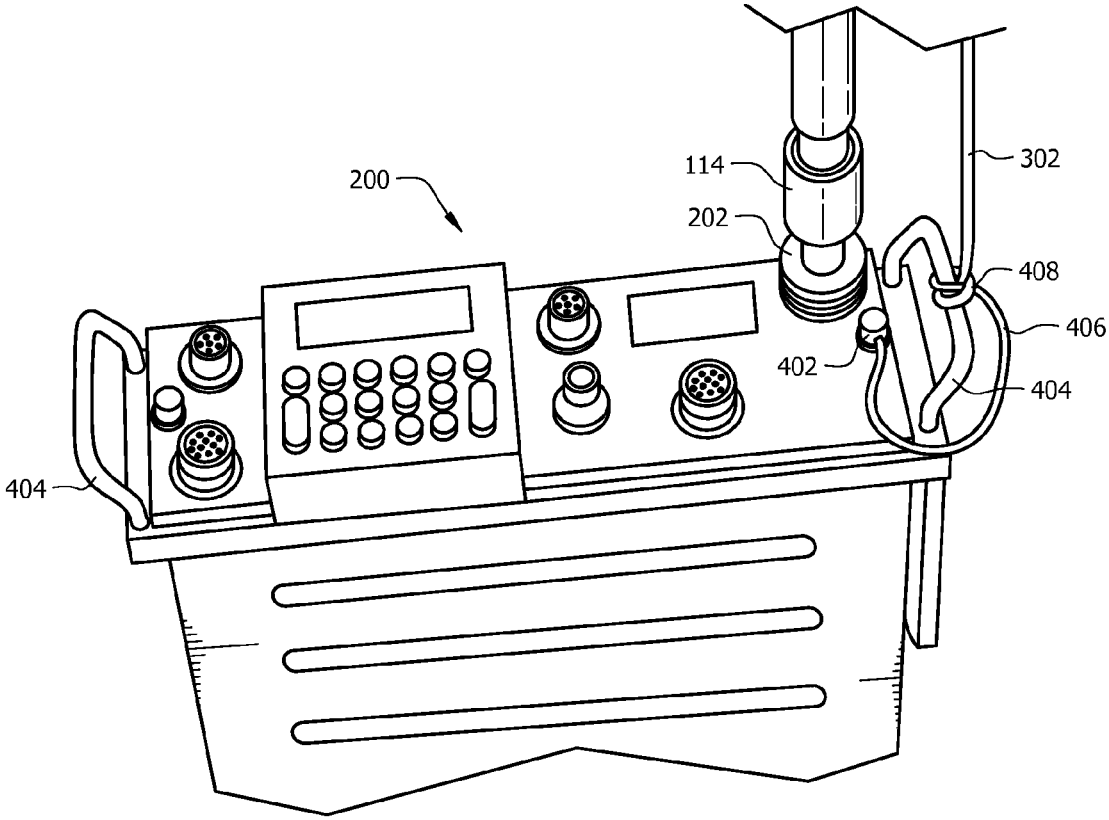
FIG. 4 is a drawing is an enlarged view of the antenna feed port and ground lug connections in FIG. 3.

Referring now to FIG. 4, there is shown an enlarged view of the portable transceiver 200. As can be observed in FIG. 4, the first flexible conductor 302 is physically secured at one end to a ground post 402 of the portable radio transceiver 200. As is common in certain portable transceivers, the ground post 402 can be situated adjacent to an RF connector 202 at a feed point (RF connector 114) of the portable whip antenna. The first flexible conductor 302 can be connected to the ground post 402 using any suitable means. For example, in some embodiments, the first flexible conductor 302 can have a lug (not shown) provided on an end thereof. The lug can be fitted over or around the ground post 402 to facilitate securing of the first flexible conductor 302 to the ground post 402. Still, the invention is not limited in this regard, and any other suitable means can be provided to form an electrical connection between the chassis ground of the portable transceiver and the first flexible conductor 302.

The first flexible conductor 302 can extend directly from the ground post 402 in some embodiments of the invention. However, in order to avoid damaging the ground post, it can be desirable to provide some form of strain relief. Any suitable arrangement can be provided for purposes of implementing such strain relief. For example, in some embodiments of the invention, this strain relief can be provided by tying a flexible conductor portion 406 of the first flexible conductor around a carrying handle 404. Alternatively, a clip (not shown) can be secured to the flexible conductor portion 406, and the clip can be removably secured to a carrying handle 404 attached to the portable transceiver. Accordingly, the first flexible conductor can be quickly detached from the portable transceiver as needed. In addition to the strain relief function, this arrangement can advantageously provide a slightly larger distance between the first flexible conductor 302 and the monopole radiating element 306. Still, the invention is not limited to the strain relief arrangement described herein and the strain relief system can be omitted entirely in many applications.

Figure 5:
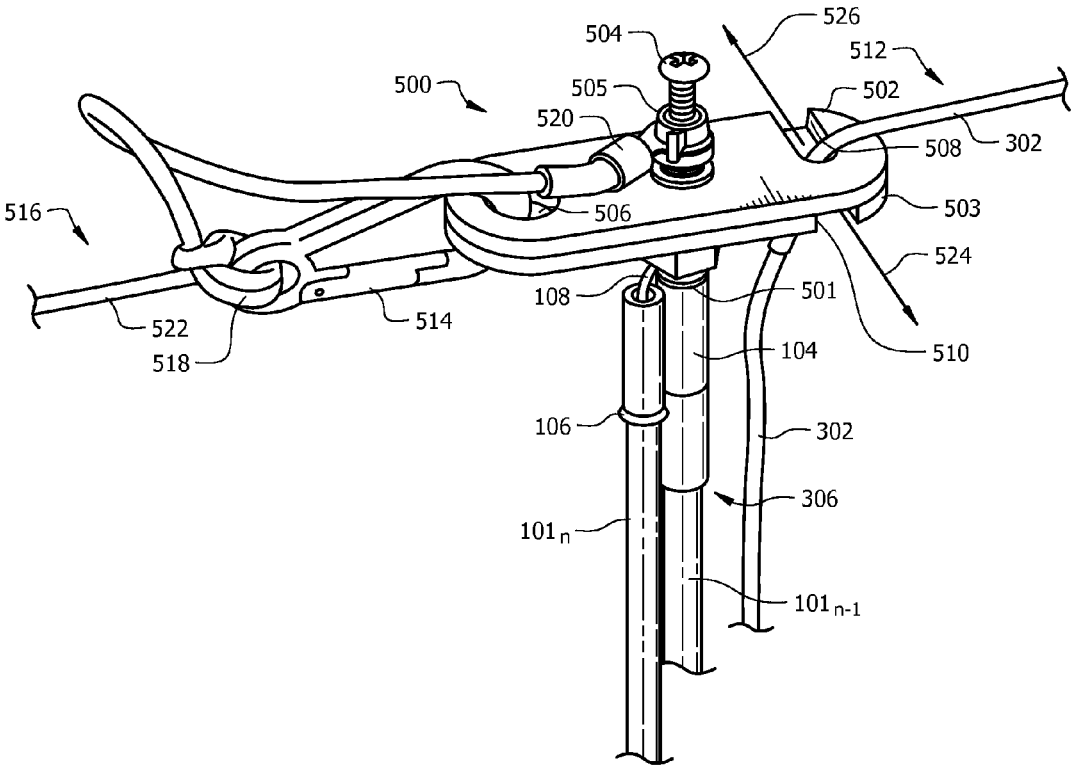
FIG. 5 is a drawing that is useful for understanding a link member that can be used to facilitate a dipole antenna system using the portable whip antenna of FIG. 1.

Referring now to FIG. 5, a link member 500 is secured to an end portion 501 of the monopole radiating element 306, distal from the feed point (RF connector 114). Note that the term "end portion" as used herein does not necessarily mean the terminal end of the fully assembled monopole radiating element 306. Since a portable whip antenna 100 can be formed of a plurality of tubular conductive sections $\mathbf{101}_1$-$\mathbf{101}_n$, an end portion 501 of the monopole radiating element 306 can refer to an end of any final assembled tubular conductive section forming a partially assembled whip antenna 100. Generally, such end will comprise a socket 104, but the invention is not limited in this regard. An "assembled tubular conductive section" is a tubular conductive section where a plug 106 of that tubular conductive section $\mathbf{101}_1$-$\mathbf{101}_n$ is inserted into a socket 104 of an adjacent tubular conductive section to form a length of the monopole radiating element 306. For example, in FIG. 5, an antenna has n tubular conductive sections $\mathbf{101}_1$-$\mathbf{101}_{in}$. All n tubular conductive sections are assembled except for a last or terminal tubular conductive section $\mathbf{101}_n$, which is allowed to hang freely by its cord 108. In this example, a socket 104 on the second to last tubular conductive section ($\mathbf{101}_{n-1}$) would be considered the end portion of the monopole radiating element 306.

In the present invention, it can be advantageous to allow at least one tubular conductive section to remain disassembled as shown in FIG. 5. Leaving at least one tubular conductive section disassembled in this way exposes a socket 104 of the next lower tubular conductive section. The exposed socket 104 in this scenario provides a useful mounting point for the link member 500. This advantage will become more apparent as the discussion progresses. Still, it should be understood that the invention is not limited in this regard.

Figure 6:
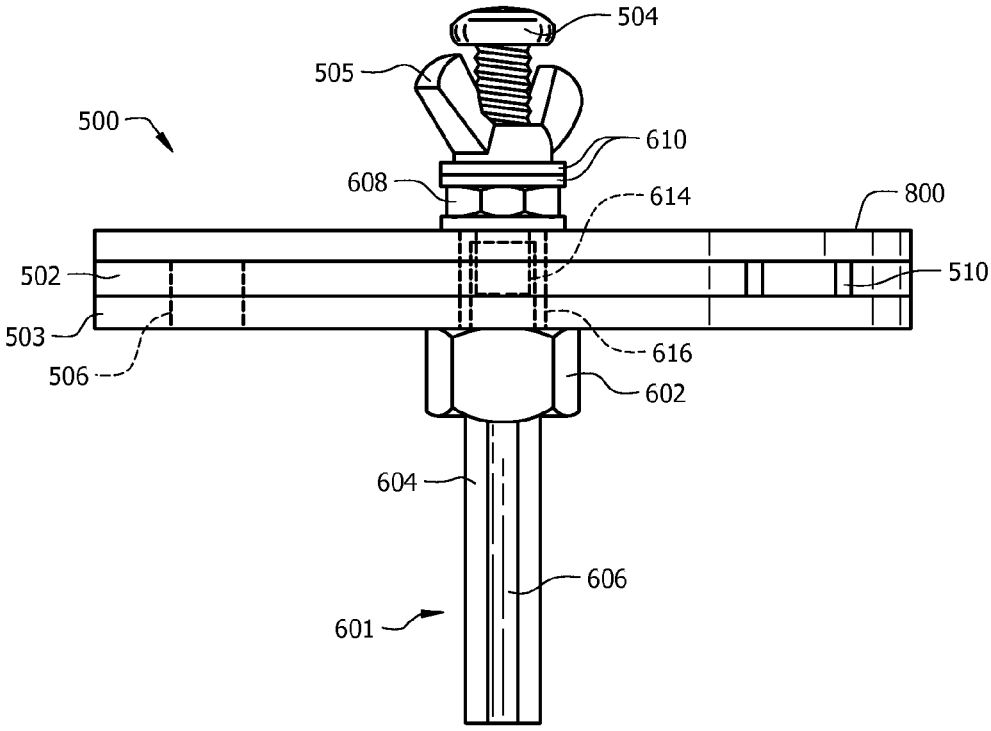
FIG. 6 is a more detailed view showing the link member of FIG. 5.

Referring now to FIGS. 5 and 6, the link member 500 will be described in further detail. Note that link member 500 as shown in FIG. 6 includes one additional component as compared to the link member 500 shown in FIG. 5. The additional component, which is optional, is an attachment plate 800 which will be described in further detail in relation to FIG. 8. For the purposes of the present discussion, the attachment plate 800 can be ignored.

As shown in FIGS. 5 and 6, the link member 500 is advantageously comprised of one or more support elements 502, 503. The support elements 502, 503 are preferably formed of a dielectric material to avoid interfering with the operation of the antenna system. In some embodiments, the support elements 502, 503 are formed of a rigid dielectric material configured for supporting first and second dipole elements 512, 516 respectively at an end portion 501 of the monopole antenna radiating element 306. The support elements are preferably designed so that at least the first flexible conductor is spaced some distance from the monopole radiating element to facilitate operation of the parallel wire transmission line 304.

The support elements 502, 503 are removably attached to the end portion 501 by an arbor 601. The arbor 601 is designed to be inserted within a socket 104 of a tubular conductive section. The arbor 601 is comprised of a base 602, a shaft 606 and a bushing 614. These components can be integrally formed as a single unit. Alternatively the arbor 601 can be assembled from a plurality of separate components. In some embodiments, a groove 606 is provided along a length of the shaft 606 to provide a clearance space for a cord 108 when the shaft 606 is inserted in the socket 104. The support elements 502, 503 are supported on base 602 and each has a central bore 616 which fits snugly around the bushing 614. A post 504 is secured in the bushing 614. The post 504 can be at least partially threaded such that it can be screwed into a threaded bore formed in the bushing 614. A threaded lock-nut 608 can be disposed on the post 504. A wing-nut 505 and washers 610 are also threaded on to the post 504. The wing-nut can be threaded along the length of the post 504 to apply a compressive force to the washers 610 and the lock-nut. According to a preferred embodiment, at least one of the support elements 502, 503 is movable relative to the other. For example, in some embodiments, one or both of the support elements can be rotatable about an axis defined by the post 504.

The method continues by securing the first flexible conductor 302 in a spaced relationship relative to the monopole radiating element 306. This securing function is performed by routing the first flexible conductor through openings 508, 510 formed in the support elements 502, 503. Note that the securing function performed by the support elements 502, 503 does not require that the first flexible conductor 302 be fixed to the support elements 502, 503. For example, the first flexible conductor 302 can be allowed to slide within the openings 508, 510 formed by the support elements 502, 503, but is nevertheless considered to be secured.

After being passed through the openings 508, 510 within the support elements 502, 503, the first flexible conductor 302 can be routed in a first direction that is generally transverse to the axial length of the monopole radiating element 306. An end of the first flexible conductor 302 can then be secured to some fixed point (not shown) so that the first flexible conductor is maintained in this position transversely extended relative to the monopole radiating element. The transversely extended section of the first flexible conductor 302 forms the first dipole element 512. Note that the first dipole element 512 is galvanically isolated from the monopole radiating element 306.

Referring once again to FIG. 5, the second dipole radiating element 516 is formed by electrically connecting an elongated length of a second flexible conductor 522 to the end portion 501 of the portable whip antenna 100, and extending the second flexible conductor in a second direction transverse to the length of the elongated monopole radiating element 306. An opposing end of the second flexible conductor 522 (not shown) can then be secured to some fixed point to hold the second dipole radiating element in its transversely extended position. In some embodiments, a wire lug 520 of the second dipole element 516 can be secured between the washers 610 to form an electrical connection with the post 504 and socket 104. As noted above, the post 504 forms an electrical connection with the end portion 501 of the portable whip antenna. A strain relief clip 514 can be secured to openings 506 formed in the support elements 502, 503. The second flexible conductor 522 can be looped or knotted around a portion of the clip 514 so that stresses applied to the second flexible conductor 522 are imparted to the clip rather than the wire lug 520. Note that the support elements 502, 503 mark the beginning of the first and second dipole elements and define the end of the parallel wire transmission line 304.

In a preferred embodiment, the support elements 502, 503 can configured so that they are capable of transitioning between an open and closed configuration to facilitate the easy assembly and disassembly of a dipole antenna as described herein. When the support elements 502, 503 in the open configuration, the first flexible conductor can be moved to a position within a capture space defined between the openings 508, 510, without the need to thread the entire length of the flexible conductor through such openings. When the support elements 502, 503 are in the closed position, they can secure or capture the first flexible conductor in position within the openings 508, 510. Those skilled in the art will appreciate that many variations of support structures can be configured to accomplish the foregoing result and all such configurations are intended to be included within the scope of the invention.

Figure 7:
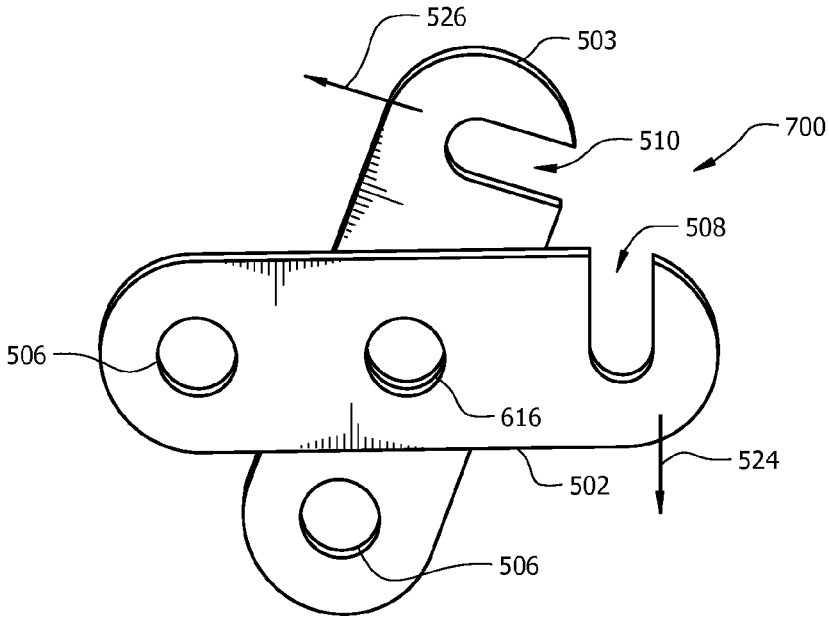
FIG. 7 is a drawing that is useful for understanding an open and closed configuration for a pair of support elements included in the link member of FIG. 5.

One configuration for providing support structures with open and closed configurations is shown in FIGS. 5 and 7. In the embodiment shown, the support elements 502, 503 can rotate with respect to each other. More particularly, one or both of the support elements can advantageously be designed to rotate on bushing 614 about an axis defined along the length of the arbor 601. When the support element 502 is rotated in a first direction indicated by the arrow 524, and/or the support element 503 is rotated in a second direction indicated by arrow 526, a gap or capture space 700 is formed between openings 508, 510. With the support elements in this position, the first flexible conductor 302 can be moved to a location between the openings 508, 510. Subsequently, when the support elements 502, 504 are returned to their original position as shown in FIG. 5, the first flexible conductor 302 can be captured in the openings 508, 510 so that the first flexible conductor 302 is secured therein. With the first flexible conductor secured in this way, the clip 514 can be inserted through openings 506 to lock the support elements in the closed position as shown in FIG. 5. When the dipole antenna is to be disassembled, this process can be reversed. Inserting a clip through openings 506 is one possible way of locking the support elements in a closed configuration; however the invention is not intended to be limited in this regard. Instead, any suitable locking mechanism can be used for this purpose.

Figure 8:
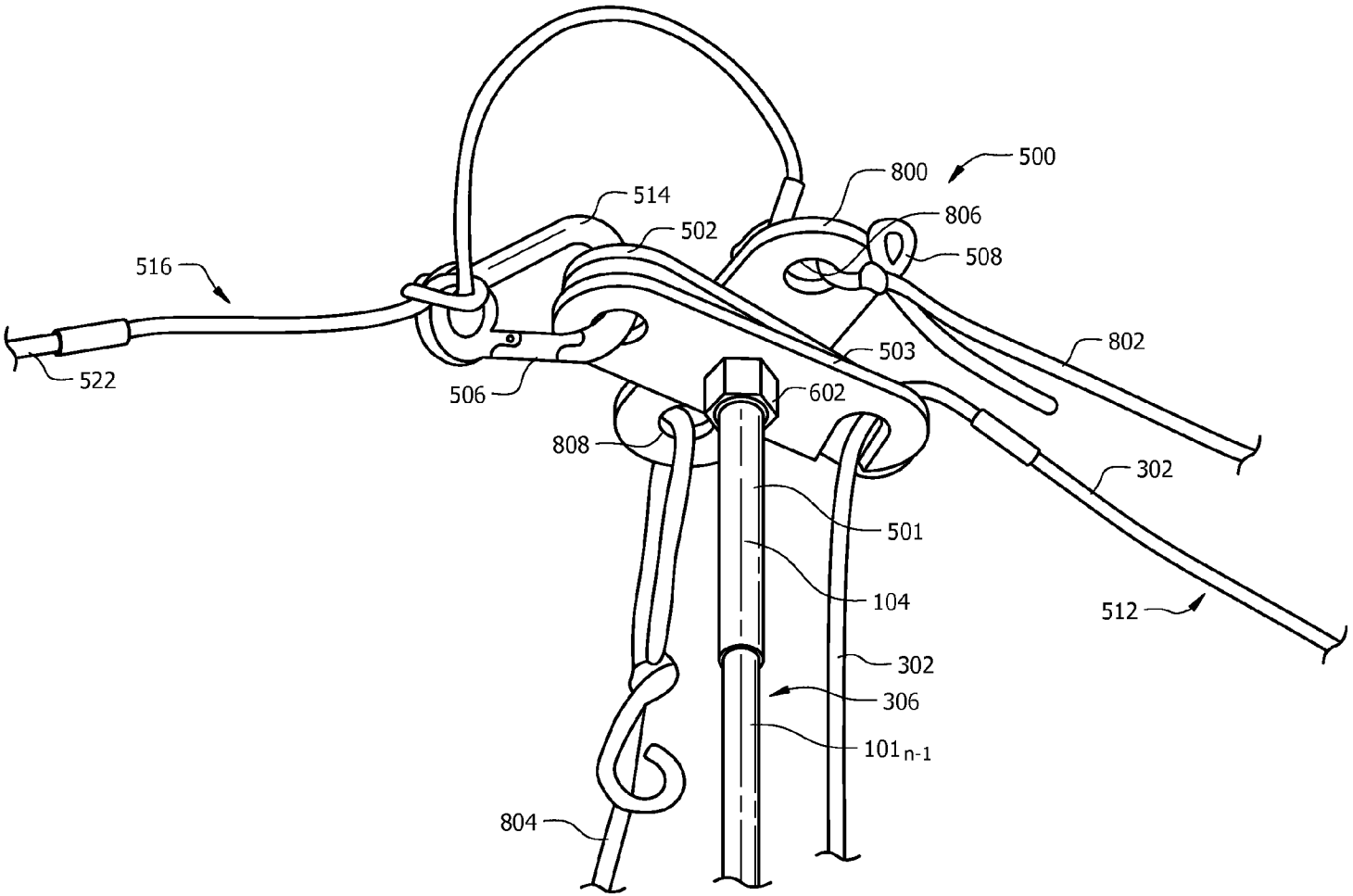
FIG. 8 is a drawing that is useful for understanding an alternative embodiment of the invention in which an attachment plate is included in the link member to provide additional mechanical support.

Those skilled in the art will appreciate that the weight of the first and second flexible conductors 302, 522 near the top of the monopole radiating element 306 can make the entire antenna assembly less stable. Accordingly, it can be desirable in some circumstances to provide additional mechanical support for the monopole radiating element 306. Referring now to FIG. 8 there is shown an alternative embodiment of the invention which includes an attachment plate 800. The attachment plate 800 can be included as part of the assembly comprising link member 500. As such, the attachment plate provides a location for attaching guy ropes 802, 804 to the monopole radiating element 306 for added stability. With reference to FIG. 5, the attachment plate 800 can rotate on the bushing 514 about an axis defined by the elongated length of the arbor 601. As shown in FIG. 8, the attachment plate 800 can advantageously be rotated to an orientation such that it is generally transverse to the first and second directions in which the dipole antenna elements are extended. The guy ropes 802, 804 can be secured to the attachment plate 800 by any suitable means. For example, in some embodiments, the guy ropes 802, 804 can be passed through bores 806, 808 formed in the attachment plate 800. Still, the invention is not limited in this regard.

Figure 9:
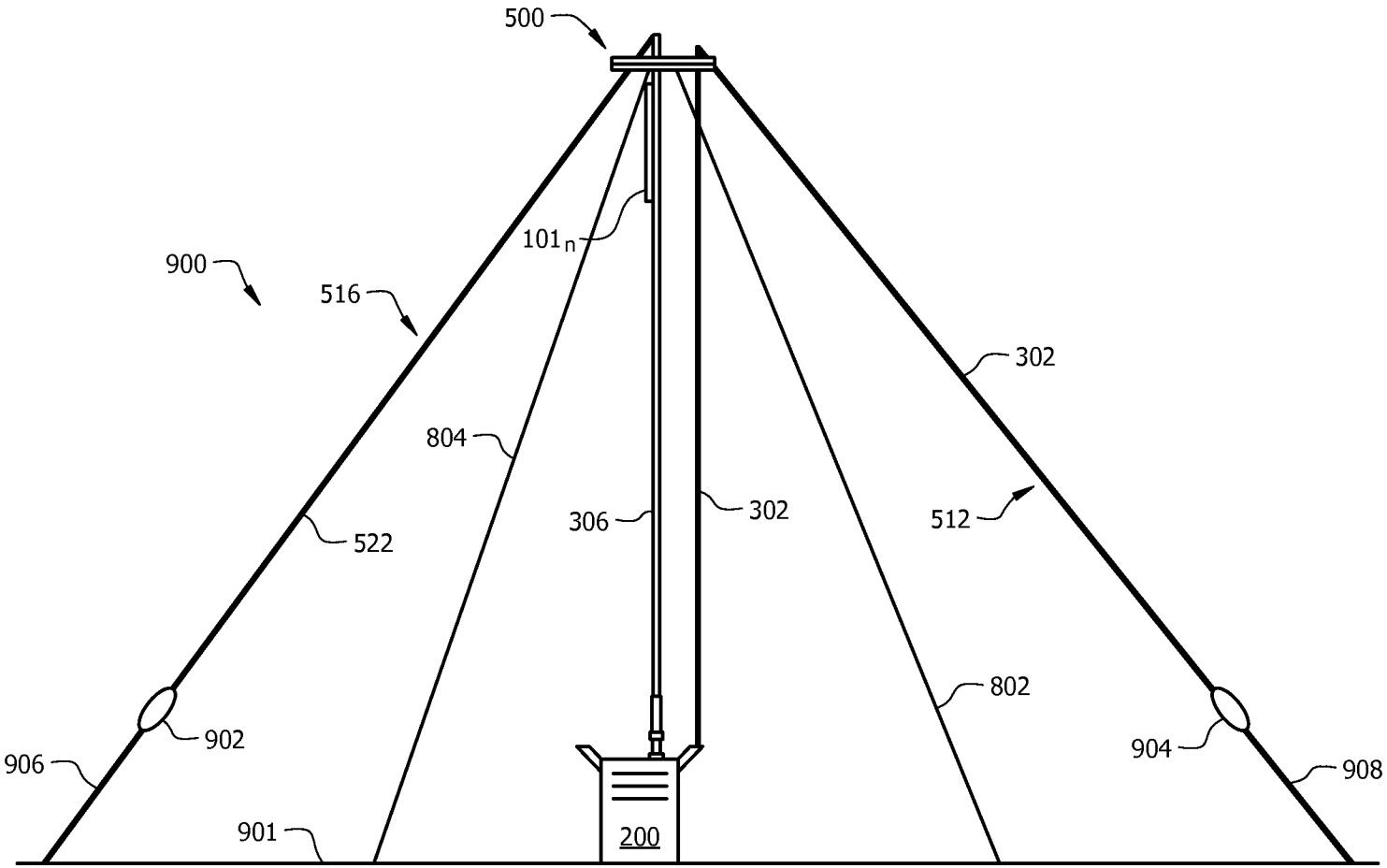
FIG. 9 is a drawing that is useful to understanding the various configurations in which the dipole antenna system of the present invention can be used.

The complete assembled dipole antenna system is shown in FIG. 9. The RF connector 114 at the feed point of the portable whip antenna 100 can be supported by the RF port 202 of a portable radio transceiver 200. Consequently, the portable whip antenna can be caused to have a generally vertical orientation with respect to the ground 901. With the portable whip antenna 100 vertically supported in this way, it can serve as a support for positioning the dipole elements 512, 516 off the surface of the ground while also serving as one element of a parallel wire transmission line 304. The ends 902, 904 of the first and second dipole elements 512, 516 are secured to any suitable fixed object. For example cords 906, 908 can be used to secure the ends 902, 904 to a fixed object. If the dipole antenna is used in an inverted vee configuration as shown, then the cords can be secured to stakes (not shown) inserted in the ground, and spaced some distance spaced apart from the portable transceiver 200. In FIG. 9, the angle between dipole elements 512, 516 is shown to be relatively small for purposes of illustration. In practice, however, the angle between dipole elements 512, 516 will generally be much larger because the dipole elements 512, 516 will often be much longer than the monopole radiating element 306. If the antenna is to be used in a flat-top configuration in which the first and second dipole elements extend in a direction that is generally parallel to the surface of the ground, then the ends 902, 904 can be attached to some other man-made or natural structure. For improved performance, dielectric insulators can be provided at the ends 902, 904.

Applicants present certain theoretical aspects above that are believed to be accurate that appear to explain observations made regarding embodiments of the invention. However, embodiments of the invention may be practiced without the theoretical aspects presented. Moreover, the theoretical aspects are presented with the understanding that Applicants do not seek to be bound by the theory presented.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the following claims.

We claim:

1. A method for adapting a portable whip antenna for use in a wire antenna system, comprising:

connecting a portable whip antenna to an RF port of a radio transceiver;

connecting one end of an elongated length of a first flexible conductor to a ground post on said radio transceiver;

forming a parallel wire transmission line, with said first flexible conductor and said portable whip antenna as parallel wire transmission line elements, by extending said first flexible conductor parallel to and spaced apart from an elongated monopole radiating element of said whip antenna;

physically securing said first flexible conductor at a location adjacent to an end portion of said portable whip antenna distal from said radio transceiver by positioning said first flexible conductor within an capture space defined by a link member, and then capturing said first flexible conductor in said capture space by transitioning a movable support element of said link member, from a first position to a second position;

extending said first flexible conductor from said location in a first direction transverse to a length of said elongated monopole radiating element to form a first dipole element; and forming a second dipole radiating element by electrically connecting an elongated length of a second flexible conductor to said end portion and extending said second flexible conductor in a second direction transverse to said elongated monopole radiating element.

2. The method according to claim 1, further comprising arranging said elongated monopole radiating element so that it extends in a direction that is generally vertical relative to the surface of the earth.

3. The method according to claim 1, wherein said step of connecting the portable whip antenna further comprises connecting the portable whip antenna directly to the radio transceiver.

4. The method according to claim 1, wherein said first flexible conductor is an insulated wire.

5. The method according to claim 1, further comprising assembling the elongated monopole radiating element from a plurality of tubular conductive sections.

6. The method according to claim 5, wherein said assembling step further comprises placing a plug formed at an end of one of said tubular conductive sections into a socket of an adjacent one of said tubular conductive sections.

7. The method according to claim 5, further comprising securing said link member at said end portion to which said first and second dipole elements are secured.

8. The method according to claim 7, wherein said securing step further comprises inserting an arbor portion of said link member into said socket in one of said tubular conductive sections.

9. The method according to claim 8, wherein said tubular conductive sections are linked together by a cord extending between tubular sections, and wherein said securing step further comprises guiding said cord into a groove defined along a length of said arbor.

10. The method according to claim 7, further comprising insulating said first dipole element from said second dipole element using said link member.

11. The method according to claim 7, further comprising locking said movable support element in said second position.

12. The method according to claim 11, wherein said locking comprises inserting a clip through an opening of said movable support element.

13. The method according to claim 12, further comprising attaching said second flexible conductor to said clip to provide a strain relief.

14. A system in which a portable whip antenna is used to form a transmission line and support for a dipole antenna, comprising:

a portable whip antenna formed of an elongated monopole radiating element and connected to an RF port of a radio transceiver;

an elongated length of a first flexible conductor connected at one end to a ground post on said radio transceiver, extending parallel to and spaced apart from said elongated monopole radiating element of said whip antenna to form in combination a parallel wire transmission line;

a link member releasably securing said first flexible conductor at a location adjacent to an end portion of said portable whip antenna distal from said radio transceiver, said link member comprising at least one movable support element arranged to transition from a first position in which said first flexible conductor can be removed from said capture space, to a second position in which said first flexible conductor is secured in said capture space;

a first dipole element formed from a portion of said first flexible conductor extending from said link member in a first direction transverse to a length of said elongated monopole radiating element;

a second dipole radiating element formed of an elongated length of a second flexible conductor, electrically connected to said end portion and extending in a second direction transverse to said elongated monopole radiating element;

wherein said whip antenna is supported by said radio port in a generally vertical orientation so that said first and second dipole elements are supported a distance off a surface of the ground.

15. The system according to claim 14, wherein said elongated monopole radiating element extends in a direction that is generally vertical relative to the surface of the earth.

16. The system according to claim 14, wherein said portable whip antenna is directly connected to the radio transceiver.

17. The system according to claim 14, wherein said first flexible conductor is an insulated wire.

18. The system according to claim 14, wherein the elongated monopole radiating element is assembled from a plurality of tubular conductive sections.

19. The system according to claim 18, wherein a plug formed at an end of each one of said tubular conductive sections is configured for insertion into a socket of an adjacent one of said tubular conductive sections.

20. The system according to claim 19, wherein said link member includes an arbor configured for insertion into said socket in one of said tubular conductive sections.

21. The system according to claim 20, wherein said arbor comprises a channel configured to provide clearance for a cord contained within said tubular conductive sections.

22. The system according to claim 14, wherein said movable member is configured to be locked in said second position.

23. The system according to claim 22, wherein said movable member is locked in said second position by means of clip which engages said movable member, and said second flexible conductor is secured to said clip.

24. A method for adapting a portable whip antenna for use in a dipole antenna system, comprising:

forming a parallel wire transmission line using a portable whip antenna and an elongated length of a first flexible conductor, by extending said first flexible conductor parallel to and spaced apart from a length of an elongated monopole radiating element of said whip antenna;

physically securing said first flexible conductor to a ground post adjacent to an RF connector at a feed point of said whip antenna;

physically securing said first flexible conductor at a location adjacent to an end portion of said portable whip antenna distal from the feed point of said whip antenna by positioning said first flexible conductor within a capture space defined by a link member, and then capturing said first flexible conductor in said capture space by transitioning a movable support element of said link member, from a first position to a second position;

extending said first flexible conductor from said location in a first direction transverse to said length of said elongated monopole radiating element to form a first dipole element;

forming a second dipole radiating element by electrically connecting an elongated length of a second flexible conductor to said end portion and extending said second flexible conductor in a second direction transverse to said length of said elongated monopole radiating element.

25. A system in which a portable whip antenna is used to form a transmission line and support for a dipole antenna, comprising:

a portable whip antenna formed of an elongated monopole radiating element extending from a feed point comprising an RF connector;

an elongated length of a first flexible conductor connected at one end to a ground post adjacent to said feed point, extending parallel to and spaced apart from said elongated monopole radiating element of said whip antenna to form in combination a parallel wire transmission line;

a link member releasably securing said first flexible conductor at a location adjacent to an end portion of said portable whip antenna distal from said feed point, said link member comprising at least one movable support element arranged to transition from a first position in which said first flexible conductor can be removed from said capture space, to a second position in which said first flexible conductor is secured in said capture space;

a first dipole element formed from a portion of said first flexible conductor extending from said link member in a first direction transverse to a length of said elongated monopole radiating element;

a second dipole radiating element formed of an elongated length of a second flexible conductor, electrically connected to said end portion and extending in a second direction transverse to said elongated monopole radiating element; and wherein said whip antenna is supported at said RF connector in a generally vertical orientation so that said first and second dipole elements are supported a distance off a surface of the ground.

* * * * *